US007975609B2

(12) United States Patent
Chrigui

(10) Patent No.: US 7,975,609 B2
(45) Date of Patent: Jul. 12, 2011

(54) PRINTING UNIT HAVING A BLANKET CYLINDER WHICH CAN BE MOVED BETWEEN A THROW-ON POSITION AND A THROW-OFF POSITION AND CORRESPONDING PRINTING PRESS

(75) Inventor: Jilani Chrigui, Creil (FR)

(73) Assignee: Goss International Montataire SA, Montataire (FR)

( * ) Notice: Subject to any disclaimer, the term of this patent is extended or adjusted under 35 U.S.C. 154(b) by 819 days.

(21) Appl. No.: 11/504,950

(22) Filed: Aug. 16, 2006

(65) Prior Publication Data

US 2007/0039494 A1 Feb. 22, 2007

(30) Foreign Application Priority Data

Aug. 19, 2005 (FR) ..... 05 08641

(51) Int. Cl.
*B41F 13/24* (2006.01)
*B41F 7/02* (2006.01)
*B41F 13/32* (2006.01)

(52) U.S. Cl. ..... 101/247; 101/218; 101/185

(58) Field of Classification Search ..... 101/218, 101/247, 182, 184, 185
See application file for complete search history.

(56) References Cited

U.S. PATENT DOCUMENTS 3,527,165 A * 9/1970 Harless ..... 101/143
3,964,387 A * 6/1976 Werner ..... 101/224
4,074,626 A * 2/1978 Werner ..... 101/221
4,108,067 A * 8/1978 Werner ..... 101/224
5,690,029 A * 11/1997 Herrmann et al. ..... 101/218
5,791,246 A * 8/1998 Kelm ..... 101/218
5,819,656 A * 10/1998 Gertsch et al. ..... 101/352.09
6,019,039 A 2/2000 Knauer et al. ..... 101/218
6,216,592 B1 * 4/2001 Knauer et al. ..... 101/247
6,227,111 B1 * 5/2001 Dawley et al. ..... 101/218
6,272,985 B1 * 8/2001 Keller et al. ..... 101/137
6,834,580 B2 * 12/2004 Thomas ..... 100/158 R
7,156,018 B2 * 1/2007 Holm et al. ..... 101/218

FOREIGN PATENT DOCUMENTS

FR 2 787 059 6/2000

* cited by examiner

*Primary Examiner* — Daniel J Colilla
*Assistant Examiner* — Leo T Hinze
(74) *Attorney, Agent, or Firm* — Davidson, Davidson & Kappel, LLC

(57) ABSTRACT

A printing unit is provided including a frame and at least a first printing group having a first plate cylinder and a first blanket cylinder which is intended to co-operate with a pressing cylinder. The printing group further includes a mechanism by means of which the first blanket cylinder can be moved between at least one throw-on position, in which it is pressed against the first plate cylinder and against the pressing cylinder, and a throw-off position, in which it is spaced apart from the first plate cylinder and the pressing cylinder. The support mechanism includes at least one main connection rod which can be moved relative to the frame and which carries the blanket cylinder. The main connection rod can be moved in rotation relative to the frame about the centre axis of the first plate cylinder.

9 Claims, 6 Drawing Sheets

PRINTING UNIT HAVING A BLANKET CYLINDER WHICH CAN BE MOVED BETWEEN A THROW-ON POSITION AND A THROW-OFF POSITION AND CORRESPONDING PRINTING PRESS

TECHNICAL FIELD

The present invention relates to a unit for printing a web of paper comprising a frame and at least a first printing group, the first printing group comprising a first plate cylinder which has a centre axis, a first blanket cylinder which has a centre axis and which is intended to co-operate with a pressing cylinder, the printing group further comprising a mechanism for supporting the first blanket cylinder, by means of which mechanism the first blanket cylinder can be moved relative to the frame between at least one throw-on position, in which the first blanket cylinder is pressed against the first plate cylinder and against the pressing cylinder, and a throw-off position, in which the first blanket cylinder is spaced apart from the first plate cylinder and the pressing cylinder, the support mechanism comprises at least one main connection rod which can be moved relative to the frame and which carries the blanket cylinder.

The invention is used in particular in offset presses, for example, for printing books.

BACKGROUND TO THE INVENTION

The throw-off position allows, for example, the blanket of the blanket cylinder to be changed.

The throw-on position allows the printing unit to print the web of paper which passes between the pressing cylinder and the blanket cylinder.

In addition to the two positions, the blanket cylinder can generally occupy an intermediate position between the throw-off and throw-on positions thereof. In this position, which allows plates to be changed, the blanket cylinder is pressed against the plate cylinder and remains spaced apart from the pressing cylinder.

The throw-off position and the plate-changing position allow the web of paper to pass between the blanket cylinder and the pressing cylinder and thus to pass through the printing unit which is in the idle state. The web of paper can at the same time continue to be printed by other printing units.

This allows a printing operation to be carried out by some units within the same printing press whilst other units in the idle state are prepared for the following printing operation.

A press of this type is generally referred to as an "Auto Transfer" press.

FR-2-787 059 describes a dual printing unit in which the plate cylinder and blanket cylinder are each carried by levers which are articulated to the frame at eccentric points of the centre axes of the cylinders.

The movement of all the levers allows the above-mentioned positions to be reached.

Printing units are also known in which the ends of the cylinders are received in eccentric bearings in order to move them in order to reach the positions mentioned above.

Finally, U.S. Pat. No. 6,019,039 describes a printing unit of the above-mentioned type. The main connection rod can be moved with an eccentric movement relative to the axis of the plate cylinder. In this manner, a movement of the main connection rod relative to the frame always changes the distance between the axes of the blanket and plate cylinders. This kinematic system is therefore complex to implement, in particular if the plate cylinders and blanket cylinders had to be held one against the other in order to reach a plate-changing position.

SUMMARY OF THE INVENTION

An object of the invention is to overcome this problem by providing a printing unit in which the movement kinematics of the cylinders is simpler and easier to implement.

To this end, the invention provides a printing unit, wherein the main connection rod can be moved in rotation relative to the frame about the centre axis of the first plate cylinder.

According to specific embodiments, the unit may include one or more of the following features, taken in isolation or according to all technically possible combinations:

- the centre axis of the first plate cylinder remains fixed relative to the frame
- when the first blanket cylinder moves between its throw-on position and throw-off position;
- the first blanket cylinder can also occupy a plate-changing position in which it is pressed against the first plate cylinder and spaced apart from the pressing cylinder;
- the support mechanism can be deflected between a configuration in which it is spaced from and a configuration in which it is close to the axes of the first plate cylinder and blanket cylinder, and the support mechanism is in a close configuration when the first blanket cylinder is in a throw-on position and the support mechanism is in a spaced configuration when the first blanket cylinder is in a throw-off position;
- the support mechanism comprises at least one device for resiliently returning the support mechanism into the spaced configuration thereof;
- the support mechanism further comprises at least one auxiliary connection rod which is articulated to the main connection rod in order to be able to pivot relative to the main connection rod about an axis which is parallel with the centre axes of the first plate cylinder and blanket cylinder, and one end of the first blanket cylinder is received so as to rotate in the auxiliary connection rod in order to allow the blanket cylinder to rotate about its centre axis;
- the resilient return device extends between the main connection rod and the auxiliary connection rod;
- the support mechanism comprises at least one unit for rotatingly receiving one end of the first blanket cylinder so that it can rotate about the centre axis thereof, and the unit can be moved in translation along the connection rod;
- the resilient return device extends between the main connection rod and the unit;
- the unit comprises at least a second printing group which comprises a second plate cylinder and a second blanket cylinder, the second blanket cylinder forming the pressing cylinder of the first blanket cylinder and the first blanket cylinder forming the pressing cylinder of the second blanket cylinder;
- the blanket cylinders of the first and second printing groups move from their throw-on positions to their throw-off positions by means of rotation about the axes of the plate cylinders in the same direction; and
- the unit comprises at least one drive motor per printing group.

The invention also provides a printing press, wherein it includes at least one printing unit as defined above.

BRIEF DESCRIPTION OF DRAWINGS

The invention will be better understood from a reading of the following description, given purely by way of example and with reference to the appended drawings, in which.

DESCRIPTION OF PREFERRED EMBODIMENTS

Figure 1:
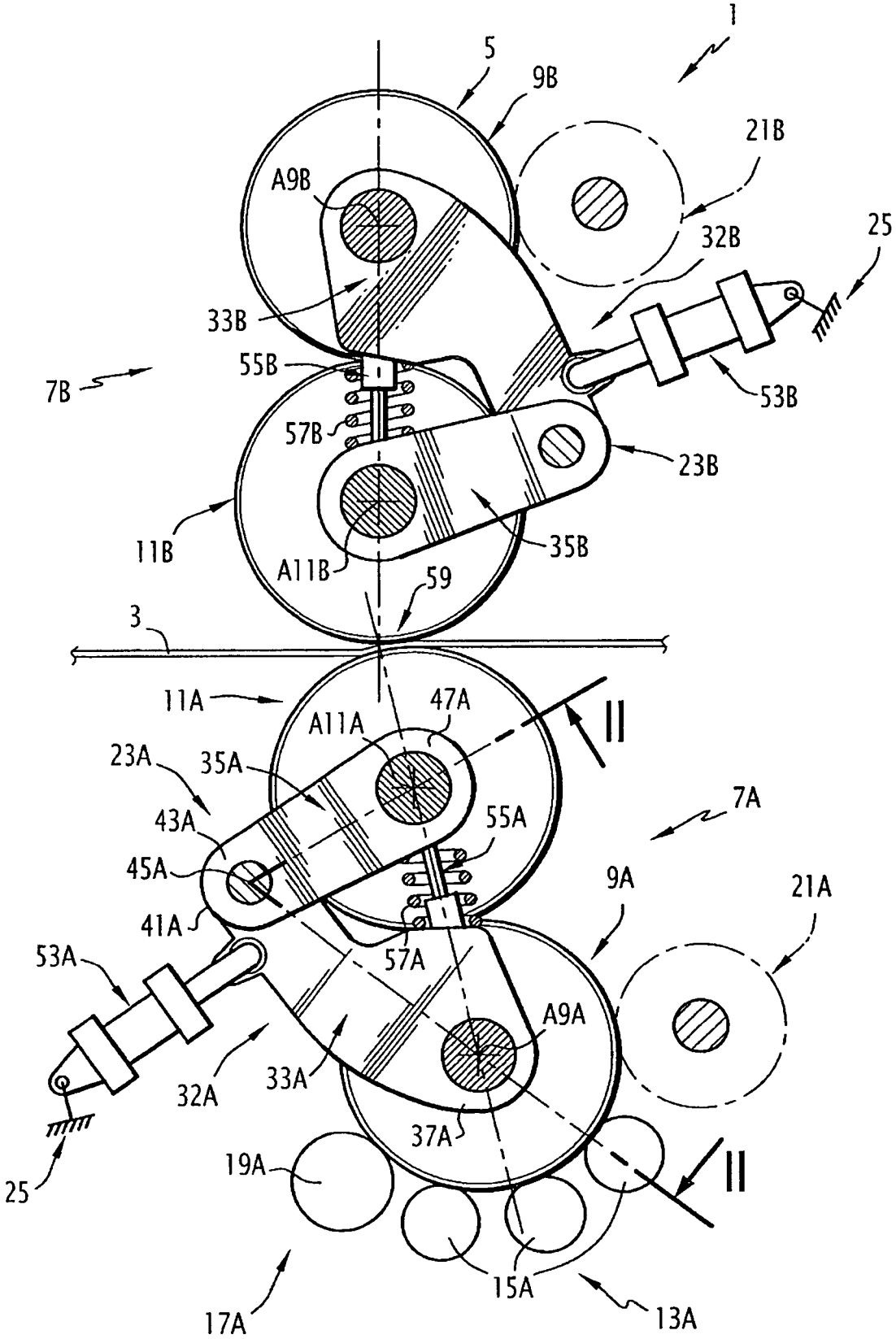
FIG. 1 is a schematic side view of a printing unit of a rotary band press according to a first embodiment of the invention, the blanket cylinders being in the throw-on position.

FIG. 1 illustrates a rotary offset press 1 which is intended to print a web 3 of paper. In the example illustrated, the passage of the web 3 is horizontal, that is to say, it will move horizontally, for example, from left to right, under the action of various conventional items of equipment which are not illustrated.

FIG. 1 illustrates a single printing unit 5 of the press 1. Typically, the press 1 will include a plurality of printing units which are arranged one after the other along the path of the web 3, for example, eight printing units which are intended, for example, to print in black, cyan, yellow and magenta. All the printing units of the press 1, or only some, may have the structure of the unit 5 which will be described below.

Figure 2:
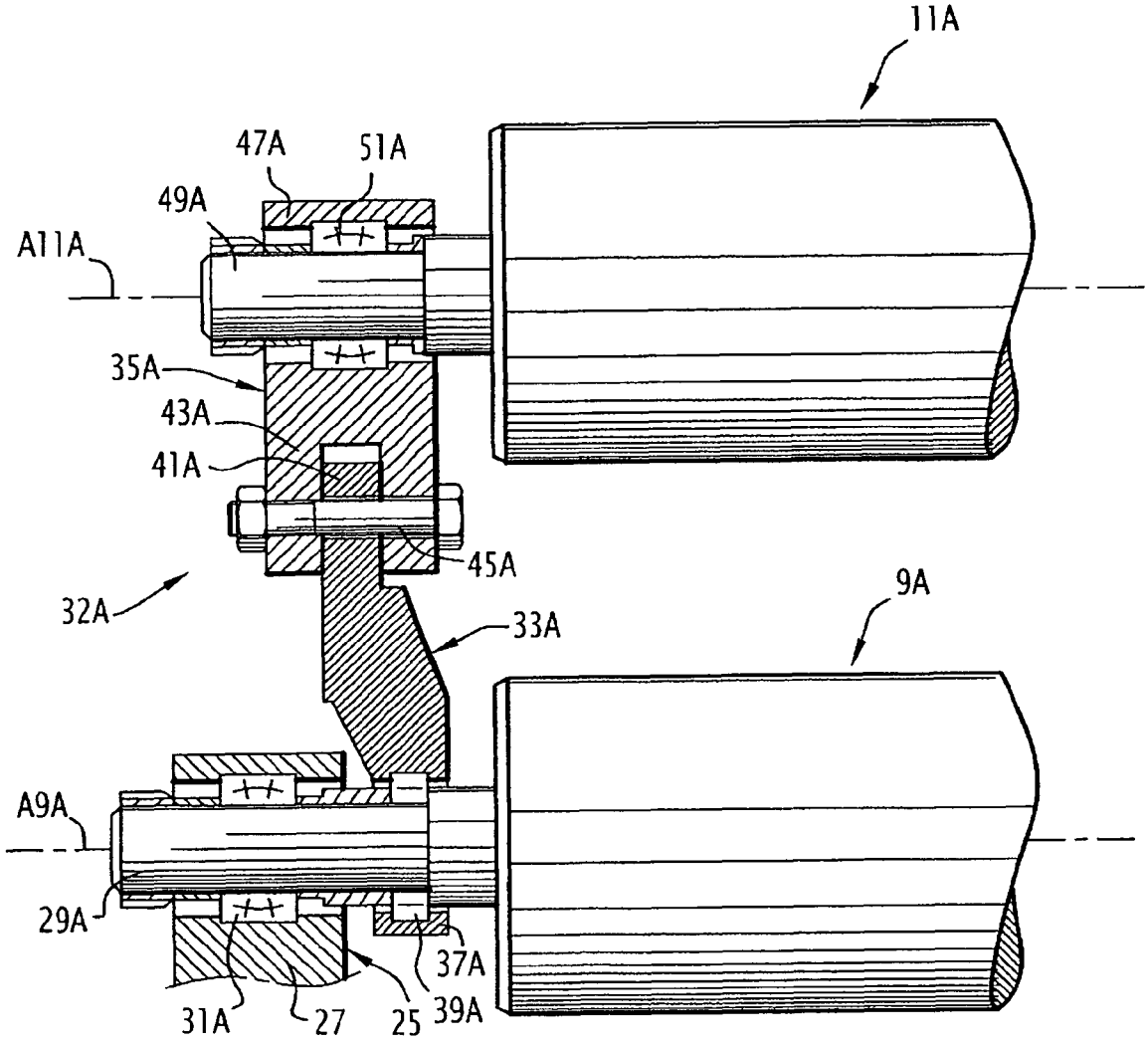
FIG. 2 is a partial schematic sectioned view, taken along the broken line II-II of FIG. 1, FIGS. 3 and 4 are views similar to FIG. 1 illustrating the blanket cylinders, in the plate-changing position and in the throw-off position, respectively.

As illustrated in FIGS. 1 and 2, the unit 5 is a dual printing unit which includes two printing groups 7A and 7B which are arranged one above the other.

The lower printing group 7A and the upper printing group 7B have similar structures so that only that of the group 7A will be described in detail below and the differences in structure between the printing groups 7A and 7B will be indicated. The reference numerals used for the printing groups 7A and 7B will be distinguished by the use of suffixes A and B.

The printing group 7A principally includes:

a plate cylinder 9A, a blanket cylinder 11A, an inking system 13A, of which only the rollers 15A in contact with the plate cylinder 9A have been illustrated, a moistening system 17A of which only the roller 19A in contact with the plate cylinder 9A has been illustrated, a drive motor 21A, and a mechanism 23A for supporting the blanket cylinder 11A.

These various elements are carried by the frame 25 of the printing unit 5.

This frame 25, only parts of which have been schematically illustrated in FIGS. 1 and 2, typically includes two lateral walls 27 (FIG. 2) which are each arranged at one side of the printing unit 5 and between which the cylinders 9A, 9B, 11A and 11B are arranged.

The lateral ends 29A of the plate cylinder 9A, only one of which can be seen in FIG. 2, are received so as to rotate in bearings 31A provided in the lateral walls 27 of the frame 25. The plate cylinder 9A can thus rotate about its centre axis A9A under the action of the motor 21A, as described below.

The mechanism 23A for supporting the blanket cylinder 11A includes two assemblies 32A which are arranged at one side and the other of the lower printing group 7A. Only the assembly 32A which can be seen in FIGS. 1 and 2 will be described below, the other having a symmetrical structure relative to a vertical and median plane of the printing unit 5.

The assembly 32A includes a main connection rod 33A and an auxiliary connection rod 35A. The main connection rod 33A and auxiliary connection rod 35A form an elbow-like joint which is directed towards the left in FIG. 1. It can be seen that the elbow-like joint formed by the main connection rod 33B and auxiliary connection rod 35B is directed in the opposite direction.

The lower end 37A of the main connection rod 33A is mounted so as to rotate on the corresponding end 29A of the plate cylinder 9A, for example, by means of a bearing 39A having cylindrical rollers (FIG. 2).

Figure 3:
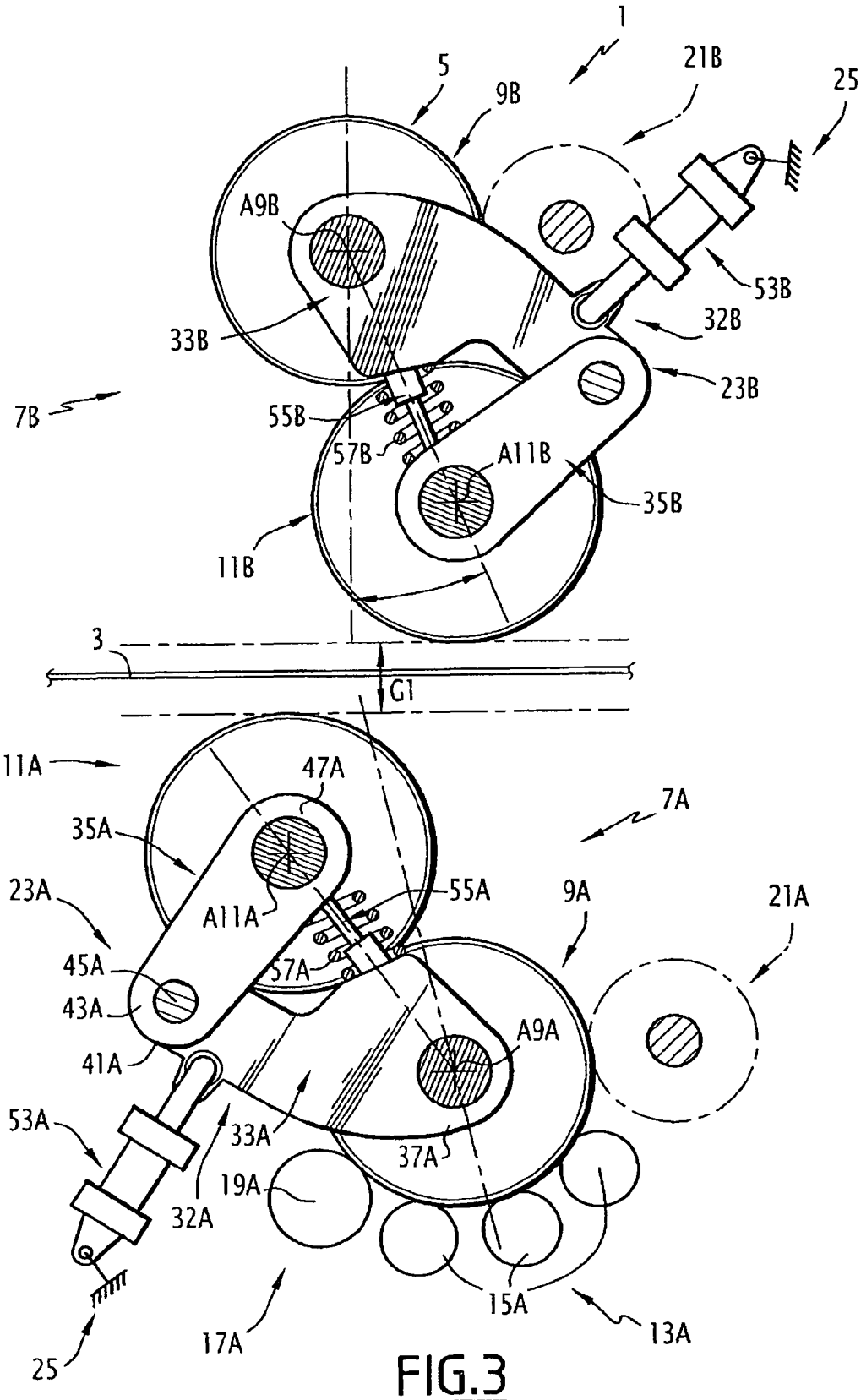
Figure 4:
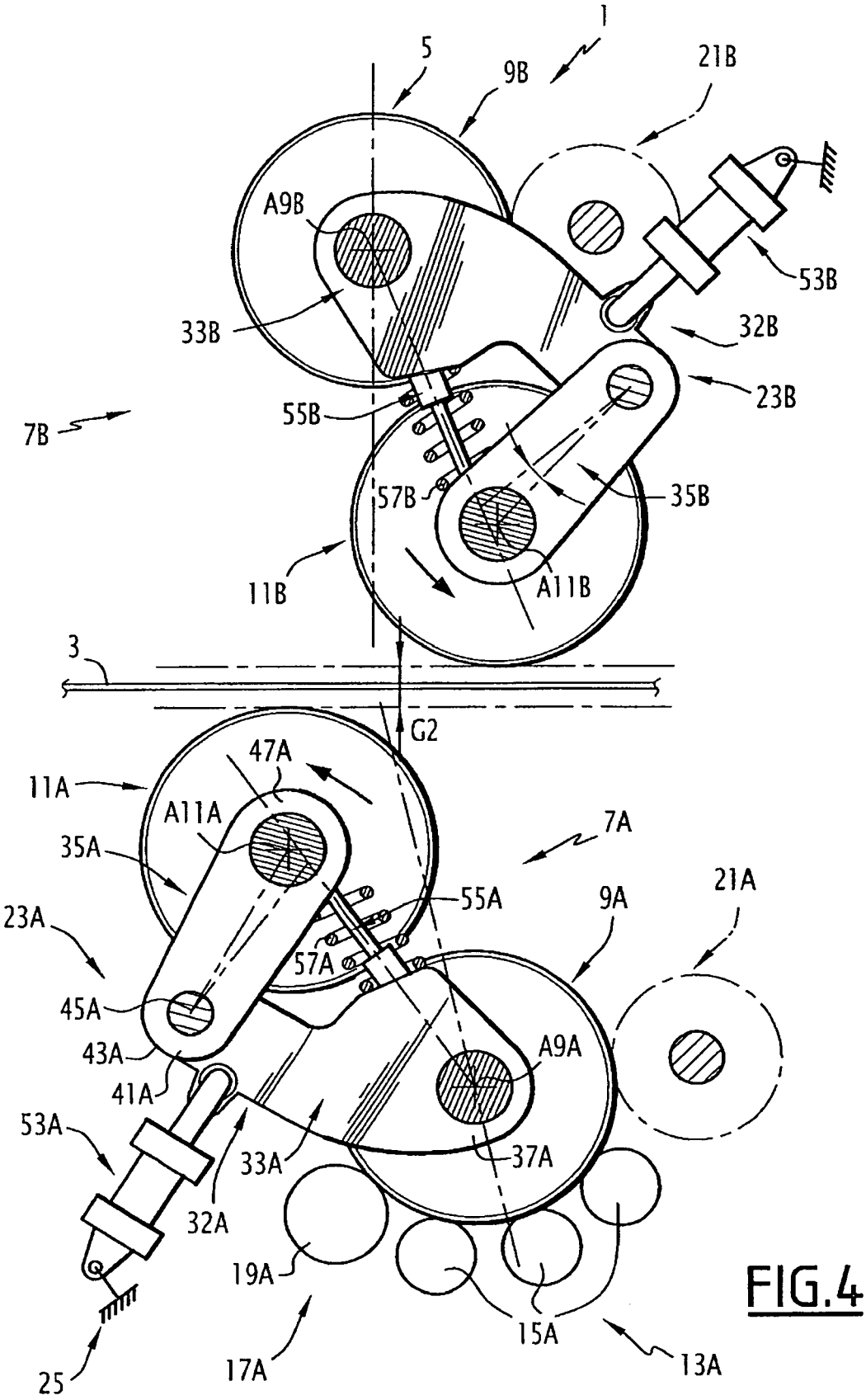

The main connection rod 33A can thus pivot about the centre axis A9A of the plate cylinder 9A between an upright position (FIG. 1) and an inclined position (FIGS. 3 and 4).

The upper end 41A of the main connection rod 33A is articulated to the lower end 43A of the auxiliary connection rod 35A by means of a pivot 45A. The auxiliary connection rod 35A can thus pivot relative to the main connection rod 33A, about an axis which is parallel with the centre axes A9A and A11A of the cylinders 9A and 11A, between a retracted position (FIGS. 1 and 3) and a deployed position (FIG. 4).

The upper end 47A of the auxiliary connection rod 35A receives the corresponding end 49A of the blanket cylinder 11A so as to rotate by means of a bearing 51A. The blanket cylinder 11A can thus rotate relative to the auxiliary connection rod 35A about the centre axis A11A thereof.

The assembly 32A also includes an element 53A for moving the main connection rod 33A. This is a pneumatic jack in the example illustrated. This jack 53A is interposed between the frame 25 and the main connection rod 33A.

The assembly 32A also includes an element 55A for moving the auxiliary connection rod 35A. In the example illustrated, it is a pneumatic jack which is connected to the connection rods 33A and 35A.

This jack 55A is coupled with a device 57A for resiliently returning the auxiliary connection rod 35A into the deployed position thereof. In the example illustrated, this is a spring which is supported on the connection rods 33A and 35A and which surrounds, for example, the jack 55A.

The mechanism 23A can therefore be deflected between a configuration shown in (FIG. 4 and a configuration shown in FIGS. 1 and 3. In the configuration shown in FIG. 4, plate cylinder axis A9A and blanket cylinder axis A11A are spaced apart from each other. In the configuration shown in FIGS. 1 and 3, the plate cylinder axis A9A and blanket cylinder axis A11A are close to each other.

In this manner, the blanket cylinder 11A can occupy three positions illustrated by the FIGS. 1, 3 and 4. In each of these Figures, the blanket cylinders 11A and 11B simultaneously occupy the same position, even if the movements of these cylinders are independent in practice.

The first position is the position referred to as throw-on and is illustrated in FIG. 1. The main connection rod 33A is in an upright position and the auxiliary connection rod 35A in a retracted position. The mechanism 23A is in a position when the axes A9A and A11A are close to each other. The blanket cylinder 11A is then pressed against the plate cylinder 9A and against the blanket cylinder 11B. The blanket cylinder 11B therefore acts as a pressing cylinder for the blanket cylinder 11A and vice-versa.

The unit 5 can then print the web 3 of paper which passes between the cylinders 11A and 11B in the region of a pinching point 59, or "nip".

During the printing operation, the motors 21A and 21B drive the cylinders 9A, 9B, 11A and 11B in rotation about their respective centre axes. This driving action can be provided, for example, by means of straight pinions which engage with each other.

In this manner, for example, in the case of the group 7A, a pinion which is fixedly joined in rotation to the output shaft of the motor 21A can engage with a pinion which is fixedly joined to the plate cylinder 9A which itself engages with a pinion which is fixedly joined to the blanket cylinder 11A. The blanket cylinder 11A is then driven in rotation about the axis A11A thereof by means of the plate cylinder 9A.

The same motors 21A and 21B can also drive the inking systems 13A and 13B (not illustrated) and moistening systems 17A and 17B (not illustrated) in rotation.

During the printing operation, and in conventional manner, the plate(s) carried by the plate cylinders 9A and 9B are moistened then inked by the systems 13A and 17A. These plates transfer the ink from the printing regions thereof to the blankets carried by the cylinders 11A and 11B which transfer the ink to the web 3 which is thus printed on both sides thereof.

It can be seen that the resilient return devices 57A and 57B, during operation of the unit 5, retain the blanket cylinders 11A and 11B in a state pressed against each other and also absorb the energy from the vibrations which may occur.

In the second position thereof, illustrated in FIG. 3, the blanket cylinder 11A is spaced from the web 3. It is therefore no longer pressed against the blanket cylinder 11B.

There is then a space between the blanket cylinder 11A and the blanket cylinder 11B which is also in the second position in FIG. 3. This space allows the web to pass freely between the blanket cylinders 11A and 11B without touching them. Typically, the height G1 of this space is approximately 30 mm. More generally, the height G1 is greater than the deflection of the web 3 which results from the tension and the physical features thereof, in conjunction with the levels of vibration which result from the excitations of the rotary press.

In this second position, the plate cylinder 9A and the blanket cylinder 11A are still pressed against each other.

This second position in which the unit 5 is non-operational allows, for example, the plates to be removed or positioned on the plate cylinders 9A and 9B, for example, using a manual, automated or semi-automated method.

The movement from the first positions to the second positions of the blanket cylinders 11A and 11B is carried out under the action of the jacks 53A and 53B by means of rotation about the axes A9A and A9B, the axes of the plate cylinders 9A and 9B remaining fixed. The main connection rods 33A and 33B then move into the inclined positions thereof. It should be noted that the rotation actions of the connection rods 33A and 33B about the axes A9A and A9B in order to move into the second position are carried out in the same direction, that is to say, in the counter-clockwise direction in FIG. 1, for the two printing groups 7A and 7B.

In the third position illustrated in FIG. 4, referred to as the throw-off position, the blanket cylinder 11A is spaced apart from the plate cylinder 9A. This spacing has been achieved by the movement of the auxiliary connection rods 35A into their deployed position, and therefore the mechanism 23A into the configuration thereof when the axes A9A and A11A are spaced apart from each other. The space delimited between the blanket cylinders 11A and 11B, when they are in their third positions, may have a height of approximately 25 mm. This third position can be used in order to change the blankets carried by the cylinders 11A and 11B.

The movement from the second to the third positions is carried out under the action of the jacks 55A and 55B by means of rotating the auxiliary connection rods 35A and 35B in the counter-clockwise direction in FIG. 3.

The movement from the third positions to the second and the first positions is carried out in the reverse order to that described above.

It should be noted that the mechanisms 23A and 23B are independent so that the rotation actions of the connection rods 33A, 33B, 35A, 35B may be different and adapted to requirements.

The movement of the blanket cylinders 11A and 11B between their first and third positions is carried out in particular by means of rotation about the axes A9A and A9B of the plate cylinders 9A and 9B, which greatly simplifies the kinematic system. In particular, the movement from the throw-on position to the plate-changing position is carried out by means of simple rotation of the main connection rods.

Furthermore, since the axes A9A and A9B remain fixed during these movements, it is not necessary to change the position of the rollers 15A and 19A or those of the motors 21A and 21B. The movements of the cylinders 11A and 11B do not therefore risk causing disruption to the inking systems 13A and 13B and moistening systems 17A and 17B and it is not necessary to make costly arrangements in order to prevent disruptions of this type.

Furthermore, this type of movement allows relatively high spacing heights G1 and G2 to be reached, ensuring that the web 3 will not be in contact with the blanket cylinders 11A and 11B in the second and third positions, without requiring an additional guiding device.

In other embodiments, the main connection rod 33A may carry the blanket cylinder 11A via elements other than the auxiliary connection rods 35A.

Figure 5:
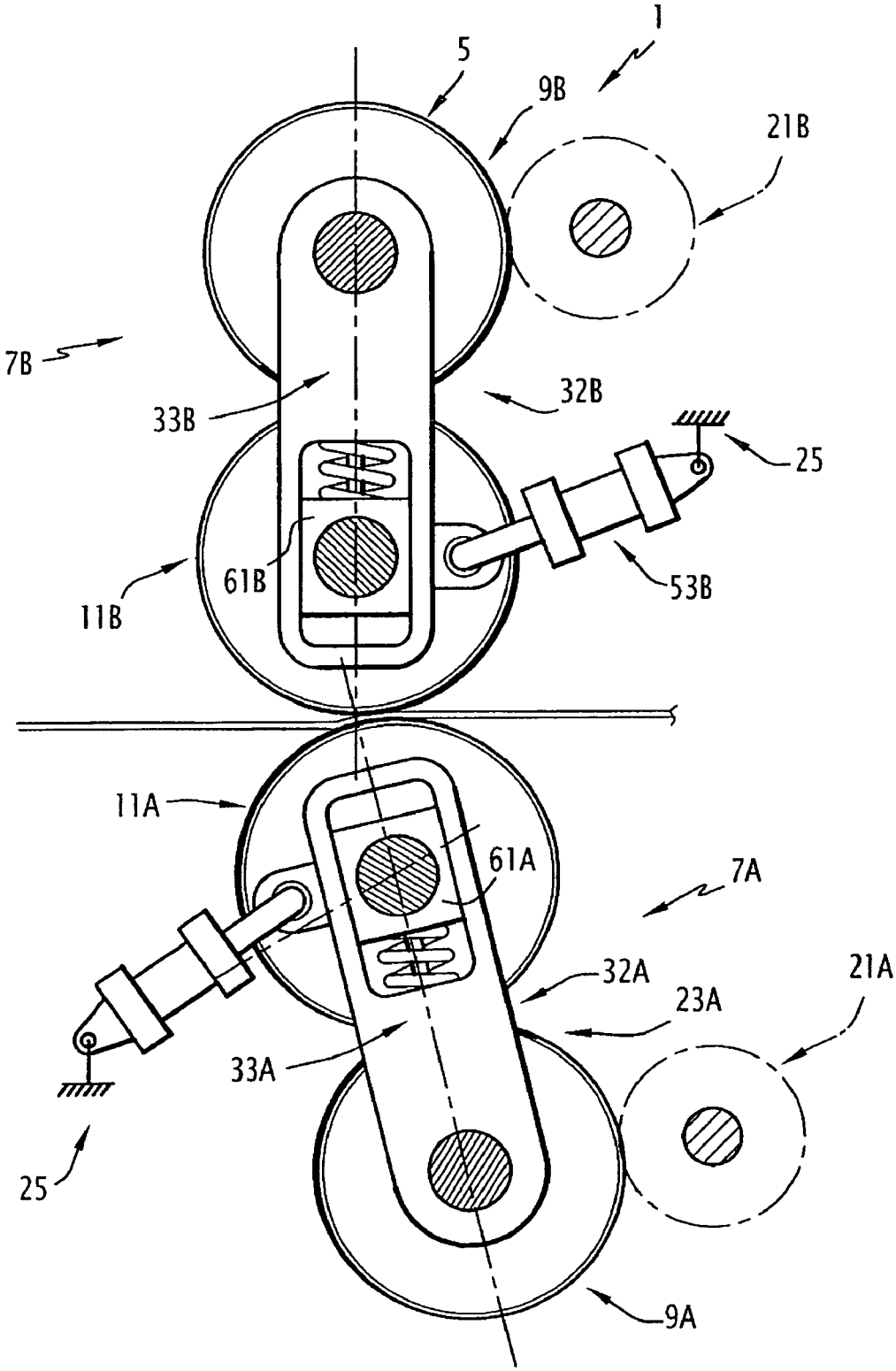
FIGS. 5 and 6 are views similar to FIG. 1, illustrating the second and third embodiments of the invention.

In this manner, FIG. 5 illustrates a second embodiment in which the support mechanisms 23A and 23B are smaller. The auxiliary connection rods 35A and 35B have been replaced by members 61A and 61B which receive the ends 49A and 49B of the blanket cylinders 11A and 11B so as to rotate. These units 61A and 61B can be moved in translation along the connection rods 33A and 33B, respectively, in order to move the blanket cylinders 11A and 11B between their second and third positions.

Figure 6:
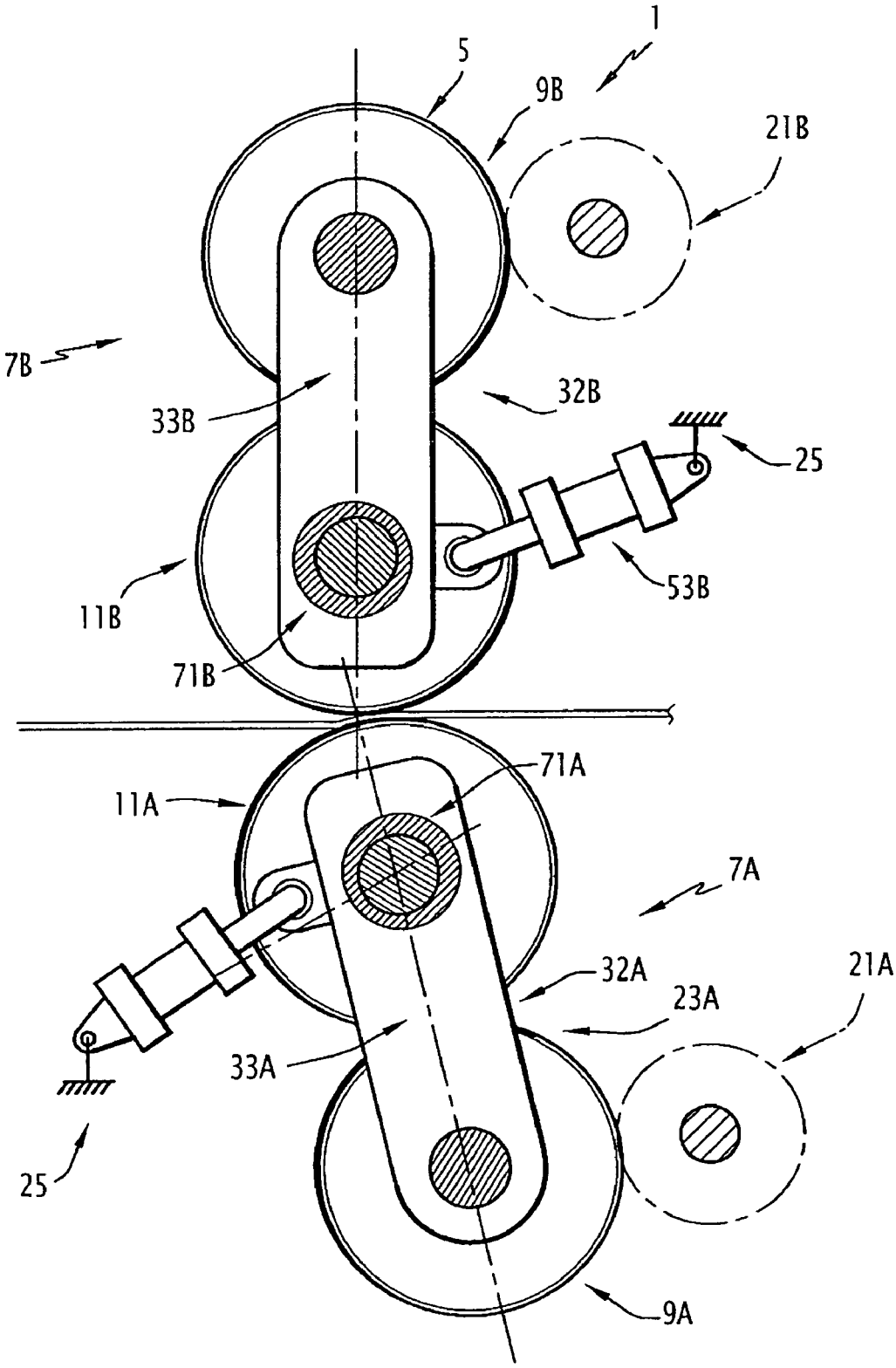

FIG. 6 illustrates still another embodiment in which the units 61A and 61B are replaced by eccentric bearings 71A and 71B which are inserted in the main connection rods 33A and 33B and which allow movement from the plate-changing position to the throw-on position.

Other embodiments of the support mechanisms 23A and 23B can be envisaged.

In the same manner, the principles described above may apply to other types of printing unit which, for example, do not comprise a moistening system, or to single printing units.

Single units of this type may include only one printing group which is provided with a plate cylinder and a blanket cylinder, and a pressing cylinder on which the blanket cylinder presses in the throw-on position.

The invention claimed is:

1. A printing unit for printing a web of paper comprising:

a frame; and at least a first printing group, the first printing group including a first plate cylinder having a center axis and a first blanket cylinder having a center axis to co-operate with a pressing cylinder;

the printing group further comprising at least one main connection rod movable with respect to the frame and carrying the blanket cylinder for supporting the first blanket cylinder and moving the first blanket cylinder with respect to the frame between at least one throw-on position, with the first blanket cylinder pressed against the first plate cylinder and against the pressing cylinder, and a throw-off position, with the first blanket cylinder spaced apart from the first plate cylinder and the pressing cylinder; and at least one auxiliary connection rod articulated to the main connection rod at a first end of the auxiliary connection rod, pivotable with respect to the main connection rod about an axis parallel with the center axes of the first plate cylinder and first blanket cylinder, one end of the first blanket cylinder received in a second end of the auxiliary connection rod opposite the first end so as to rotate in the auxiliary connection rod about the center axis thereof;

the main connection rod rotatable with respect to the frame about the center axis of the first plate cylinder.

2. The printing unit as recited in claim 1 wherein the center axis of the first plate cylinder remains fixed with respect to the frame when the first blanket cylinder moves between the throw-on position and the throw-off position.

3. The printing unit as recited in claim 1 wherein the first blanket cylinder occupies a plate-changing position when the first blanket cylinder is pressed against the first plate cylinder and spaced apart from the pressing cylinder.

4. The printing unit as recited in claim 1 wherein the at least one main connection rod is deflected between a configuration wherein the plate cylinder axis and blanket cylinder axis are spaced apart from each other and a configuration wherein the plate cylinder axis and blanket cylinder axis are close to each other, the at least one auxiliary connection rod being in the close configuration when the first blanket cylinder is in a throw-on position, the at least one auxiliary connection rod being in the spaced configuration when the first blanket cylinder is in a throw-off position.

5. The printing unit as recited in claim 4 wherein at least one main connection rod includes at least one device for resiliently returning the at least one auxiliary connection rod into the spaced configuration.

6. The printing unit as recited in claim 5 wherein the resilient return device extends between the main connection rod and the auxiliary connection rod.

7. The printing unit as recited in claim 1 wherein the main connection rod and the auxiliary connection rod are connected via a spring.

8. The printing unit as recited in claim 1 further comprising at least one drive motor per printing group.

9. A printing press comprising a printing unit for printing a web of paper, the printing unit comprising:

a frame; and at least a first printing group, the first printing group including a first plate cylinder having a center axis and a first blanket cylinder having a center axis to co-operate with a pressing cylinder, the printing group further including at least one main connection rod movable with respect to the frame and carrying the blanket cylinder for supporting the first blanket cylinder and moving the first blanket cylinder with respect to the frame between at least one throw-on position, with the first blanket cylinder pressed against the first plate cylinder and against the pressing cylinder, and a throw-off position, with the first blanket cylinder spaced apart from the first plate cylinder and the pressing cylinder; and at least one auxiliary connection rod articulated to the main connection rod at a first end of the auxiliary connection rod, pivotable with respect to the main connection rod about an axis parallel with the center axes of the first plate cylinder and first blanket cylinder, one end of the first blanket cylinder received in a second end of the auxiliary connection rod opposite the first end so as to rotate in the auxiliary connection rod about the center axis thereof;

the main connection rod rotatable with respect to the frame about the center axis of the first plate cylinder.

* * * * *